US006536399B2

(12) United States Patent
Matsuda et al.

(10) Patent No.: US 6,536,399 B2
(45) Date of Patent: Mar. 25, 2003

(54) CRANKSHAFT SUPPORTING STRUCTURE FOR HORIZONTAL OPPOSED TYPE INTERNAL COMBUSTION ENGINE

(75) Inventors: Minoru Matsuda, Saitama (JP); Makoto Sanada, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,621

(22) Filed: Nov. 15, 2001

(65) Prior Publication Data

US 2002/0056432 A1 May 16, 2002

Related U.S. Application Data

(60) Provisional application No. 60/248,194, filed on Nov. 15, 2000.

(30) Foreign Application Priority Data

Nov. 15, 2000 (JP) ..... 2000-347645
Oct. 30, 2001 (JP) ..... 2001-333338

(51) Int. Cl.[7] ..... F02B 75/24
(52) U.S. Cl. ..... 123/195 R
(58) Field of Search ..... 123/55.2, 195 R, 123/195 H, 55.5, 55.7

(56) References Cited

U.S. PATENT DOCUMENTS 6,073,595 A * 6/2000 Brogdon ..... 123/55.5
6,186,099 B1 * 2/2001 Tosaka et al. ..... 123/55.2

FOREIGN PATENT DOCUMENTS

JP 2000110582 A 4/2000

* cited by examiner

*Primary Examiner*—Gene Mancene
*Assistant Examiner*—Hyder Ali
(74) *Attorney, Agent, or Firm*—Birch, Stewart, Kolasch & Birch, LLP

(57) ABSTRACT

In a horizontally opposed type internal combustion engine, to enable rigid support of a middle journal of a crankshaft through rational utilization of first and second case halves constituting a crankcase, and to thereby contribute to a simplification in structure and a reduction in weight. In a horizontally opposed type internal combustion engine, a crankcase is split at a plane containing the axis line of a crankshaft into first and second case halves connected with first and second cylinder blocks. The first and second case halves are integrally provided with first and second journal supporting walls for supporting a middle journal of the crankshaft. The first and second journal supporting walls front cylinder bores of the first and second cylinder blocks. The first and second journal supporting walls are coupled by a plurality of first bolts inserted from the side of the cylinder bores of the first cylinder block and disposed on opposite sides of and in proximity to the middle journal.

18 Claims, 7 Drawing Sheets

CRANKSHAFT SUPPORTING STRUCTURE FOR HORIZONTAL OPPOSED TYPE INTERNAL COMBUSTION ENGINE

CROSS-REFERENCES TO RELATED APPLICATIONS

This nonprovisional application claims priority under 35 U.S.C. §119(a) on Patent Application No. 2000-347645 filed in Japan on Nov. 15, 2000, and Patent Application No. 2001-333338 filed in Japan on Oct. 30, 2001, the entirety of each of which is herein incorporated by reference. This nonprovisional application further claims priority under 35 U.S.C. §119(e) on U.S. Provisional Application 60/248,194, filed on Nov. 15, 2000, the entirety of which is herein incorporated by reference.

BACKGROUND OF THE INVENTION

1. Field of the Invention

The present invention relates to a crankshaft supporting structure for a horizontally opposed type internal combustion engine used for automobiles, motorcycles, airplanes and the like. In particular, the present invention relates to a crankshaft supporting structure for supporting a journal at an intermediate portion of a crankshaft in a horizontally opposed type internal combustion engine. The engine includes a crankshaft and pluralities of first and second pistons connected to the crankshaft. The pluralities of first and second pistons are disposed opposite to each other with the crankshaft therebetween, and are arranged with an offset from each other along the axial direction of the crankshaft. Furthermore, the engine includes a crankcase for containing and supporting the crankshaft, and first and second cylinder blocks connected to and disposed on opposite sides of the crankcase and having cylinder bores for slidably receiving the pluralities of first and second pistons therein. The crankcase is split along a plane containing the axis of the crankshaft into first and second case halves connected respectively with the first and second cylinder blocks.

2. Description of Background Art

A structure for supporting a middle journal of a crankshaft in a horizontally opposed type internal combustion engine as described above is known. First, Japanese Patent Laid-open No. 2000-110582 discloses a structure, wherein a first case half is provided integrally with a journal supporting wall for supporting a half periphery portion of a middle journal of a crankshaft. In addition, a bearing cap for supporting the other half periphery portion of the journal is bolt-connected to the journal supporting wall. Second, a structure is known, wherein first and second case halves are provided integrally with first and second journal supporting walls for respectively supporting half periphery portions of a middle journal. The first and second journal supporting walls are bolt-connected at outside portions thereof.

However, in the first structure above, the bearing cap is required to connect to the first case half. Accordingly, the number of component parts is increased. Furthermore, the second case half cannot contribute greatly to reinforcement of the support for the crankshaft. On the other hand, in the second structure above, the distance from the middle journal of the crankshaft to the bolt connection portions of the case halves is required to be large. Accordingly, not only the journal supporting wall but also portions of the crankcase must be increased in thickness for the purpose of obtaining sufficient support rigidity for the crankshaft. This results in an increase in the weight of the internal combustion engine.

SUMMARY OF THE INVENTION

The present invention has been made in consideration of the above-mentioned points. Accordingly, an object of the present invention is to provide a crankshaft supporting structure for a horizontally opposed type internal combustion engine which utilizes the first and second case halves of the crankcase to rigidly support the middle journal of the crankshaft. With this structure, a simplification in structure and a reduction in weight are accomplished.

In order to attain the above object, a horizontal opposed type internal combustion engine includes a crankshaft and pluralities of first and second pistons connected to the crankshaft, disposed opposite to each other with the crankshaft therebetween and arranged with an offset from each other along the axial direction of the crankshaft. A crankcase is included for containing and supporting the crankshaft, and first and second cylinder blocks are connected to and disposed on opposite sides of the crankcase and have cylinder bores for slidably receiving the first and second pluralities pistons. The crankcase is split along a plane containing the axis line of the crankshaft into first and second case halves connected respectively with the first and second cylinder blocks. The first and second case halves are integrally provided with first and second journal supporting walls rotatably supporting a middle journal of the crankshaft therebetween. The first and second journal supporting walls front the cylinder bores of the first and second cylinder blocks, and the first and second journal supporting walls are connected by a plurality of first bolts inserted from the side of the cylinder bore of the first cylinder block and disposed on opposite sides of and in proximity to the middle journal.

According to the first characteristic feature, the first and second journal supporting walls for supporting therebetween the middle journal of the crankshaft can easily be bolt-connected, without being interfered with by the first and second cylinder blocks.

In addition, since the journal supporting walls are bolt-connected on both sides of and in proximity to the middle journal of the crankshaft, rigidity of support for the middle journal of the crankshaft can be enhanced effectively. As a result, the crankcase can be reduced in wall thickness, leading to a reduction in weight.

In addition, the bearing cap for supporting the crankshaft is unnecessary. Accordingly, it is possible to obtain a reduction in the number of component parts and a simplification in structure.

In addition to the first characteristic feature, the present invention also includes the first and second journal supporting walls connected by a plurality of second bolts inserted from the side of the cylinder bore of the second cylinder block and arranged on opposite sides of and in proximity to the middle journal.

According to the second characteristic feature, even though the amount of exposure of the first and second supporting walls into the cylinder bores of the first and second cylinder blocks is small and the bolts to be used are small in diameter, the journal supporting walls can be connected by at least four bolts inserted from the first and second cylinder blocks. As a result, the journal supporting walls can be provided with sufficient binding force.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

The present invention will now be described with reference to the accompanying drawings.

Figure 1:
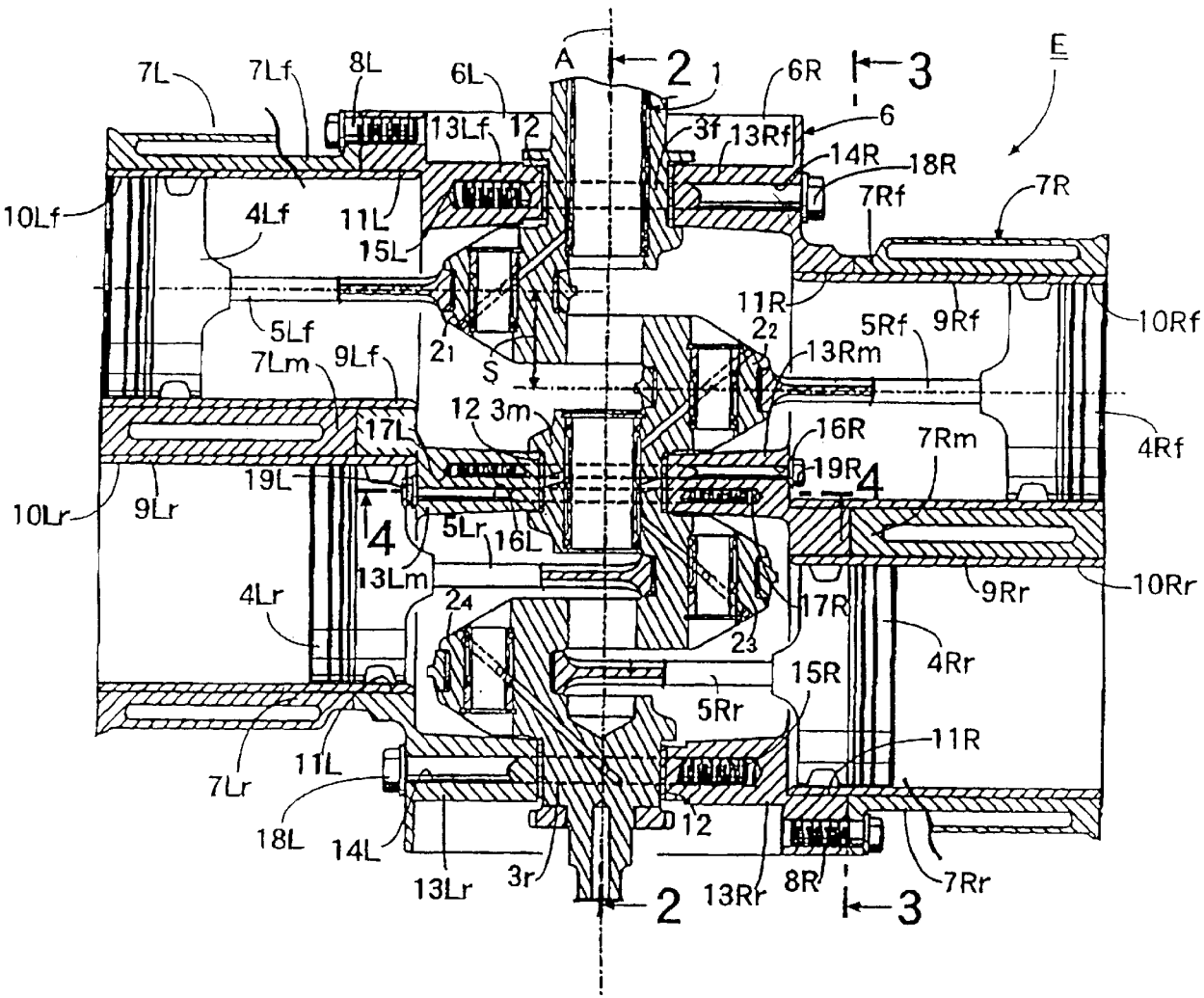
FIG. 1 is a vertical sectional view of a horizontally opposed type internal combustion engine comprising a crankshaft supporting structure according to the present invention.
Figure 2:
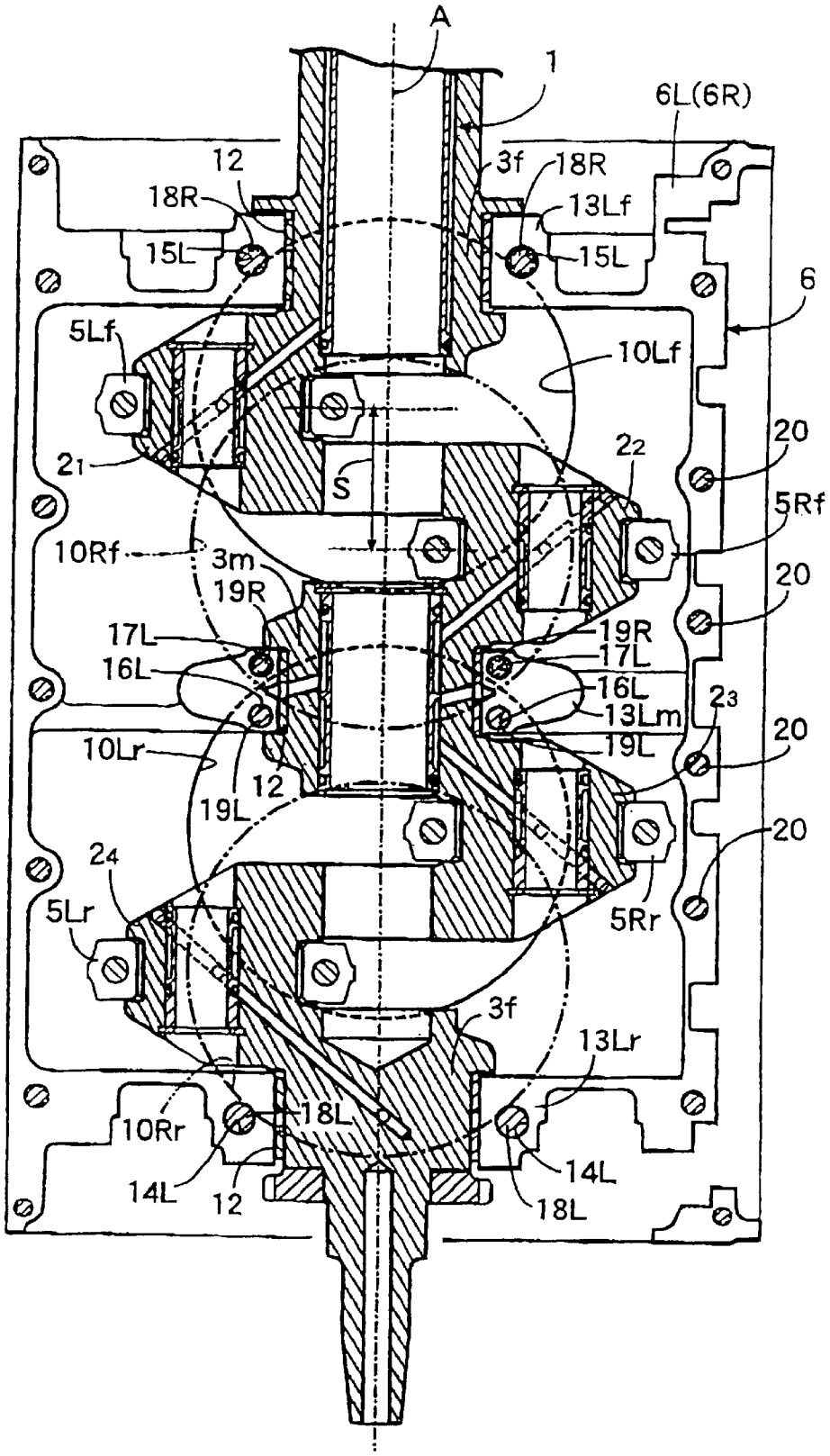
FIG. 2 is a sectional view taken along line 2—2 of FIG. 1.
Figure 3:
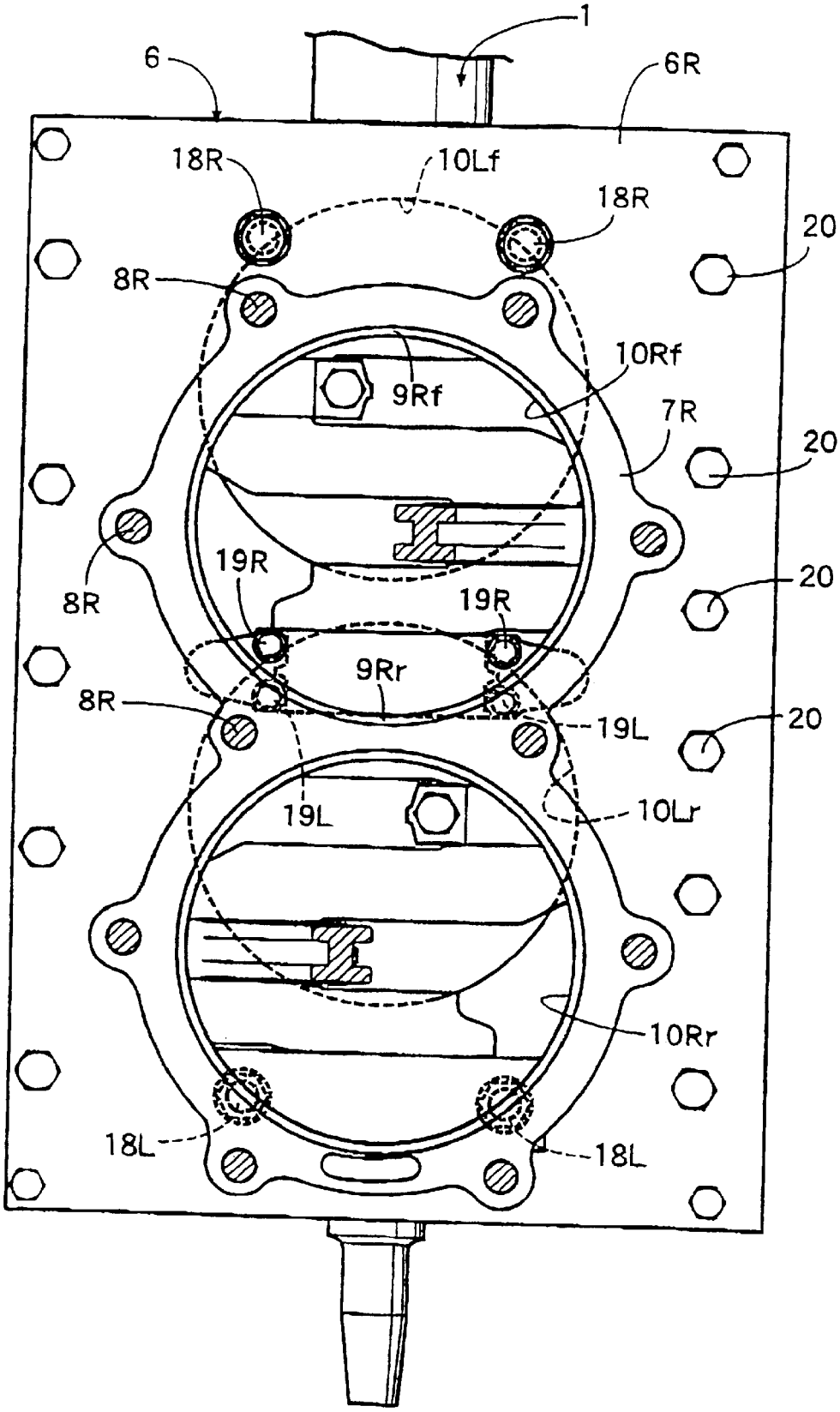
FIG. 3 is a sectional view taken along line 3—3 of FIG. 1.
Figure 4:
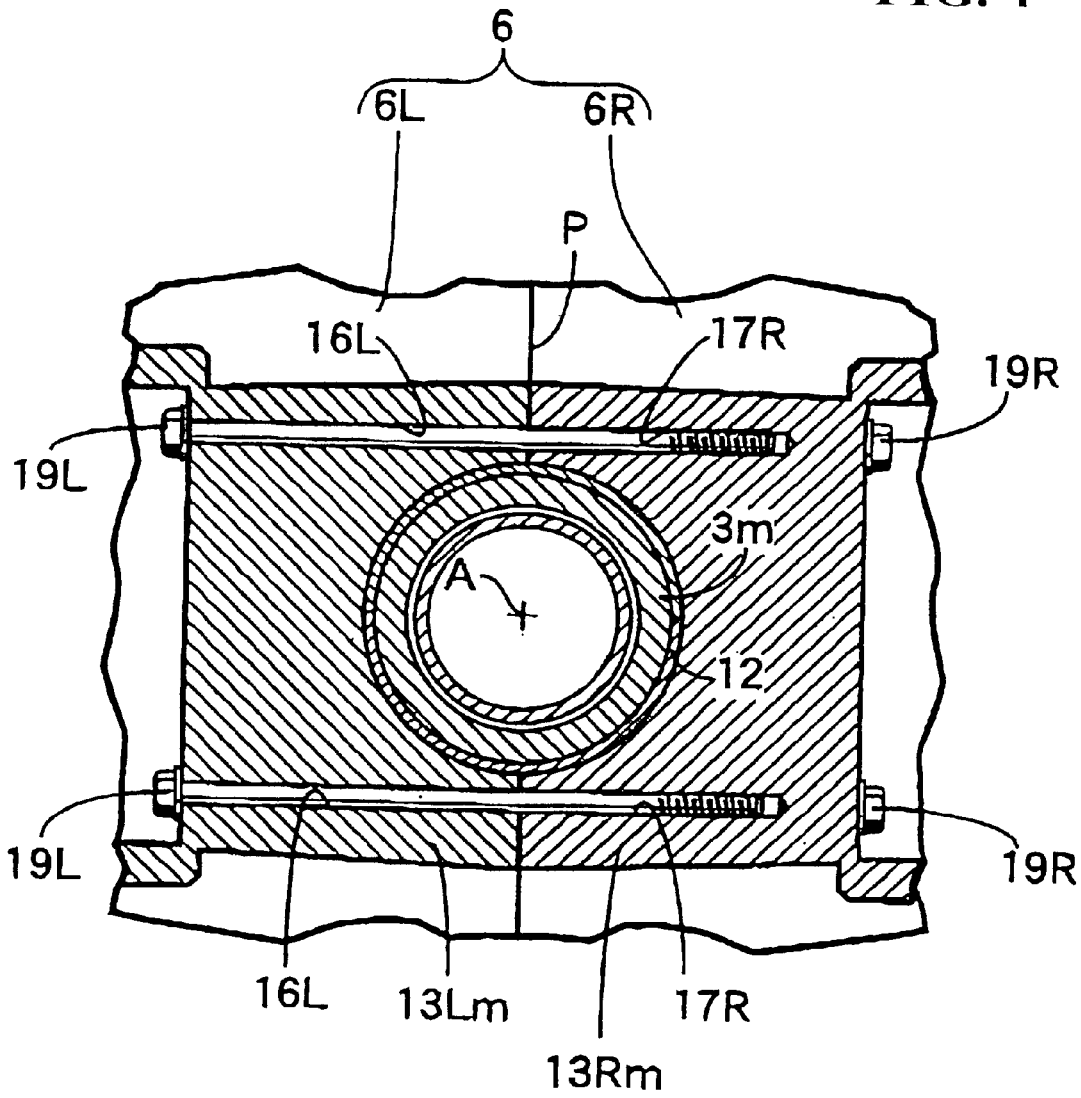
FIG. 4 is a sectional view taken along line 4—4 of FIG. 1.
Figure 5:
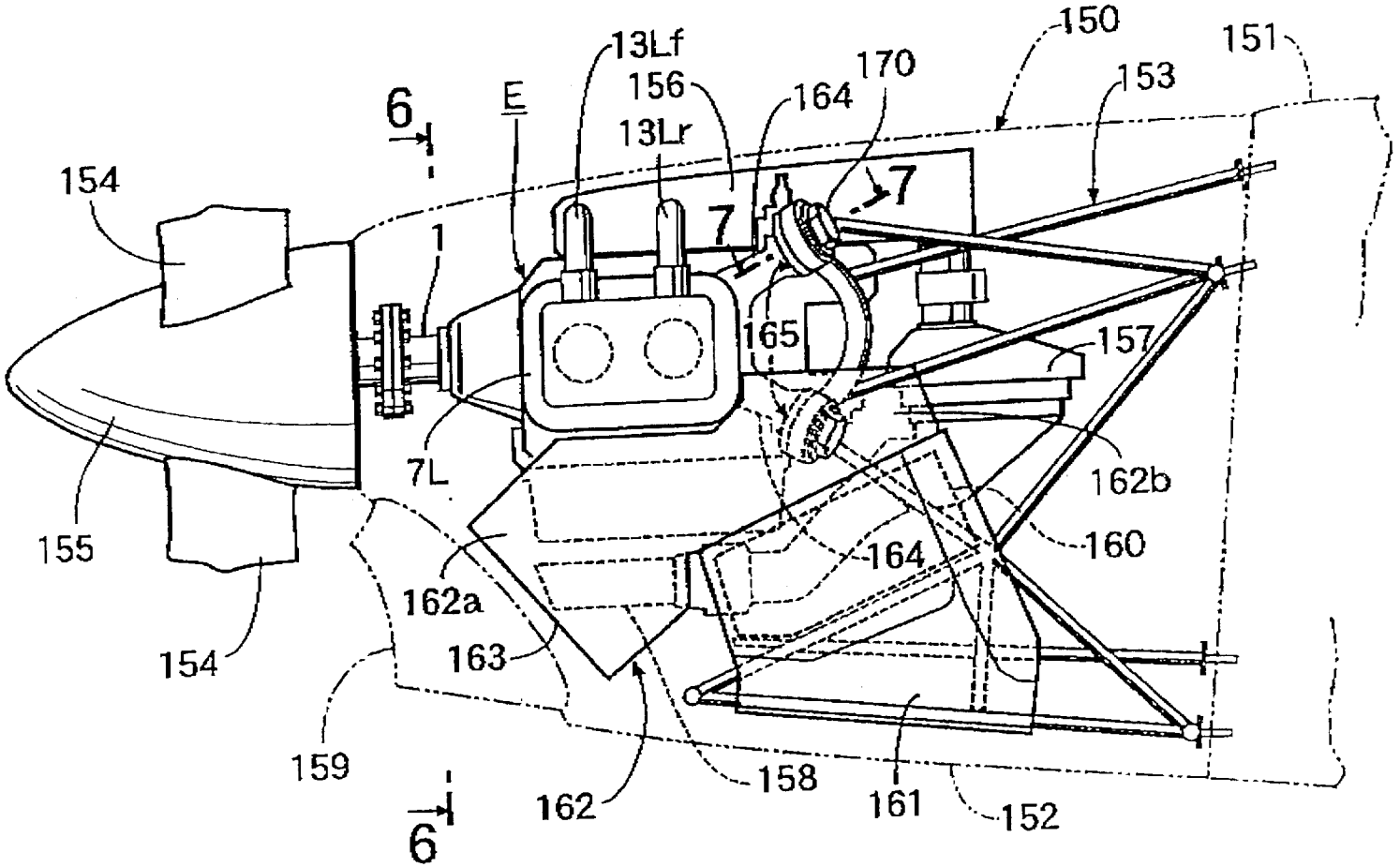
FIG. 5 is a side elevational view showing an engine installed in an airplane.
Figure 6:
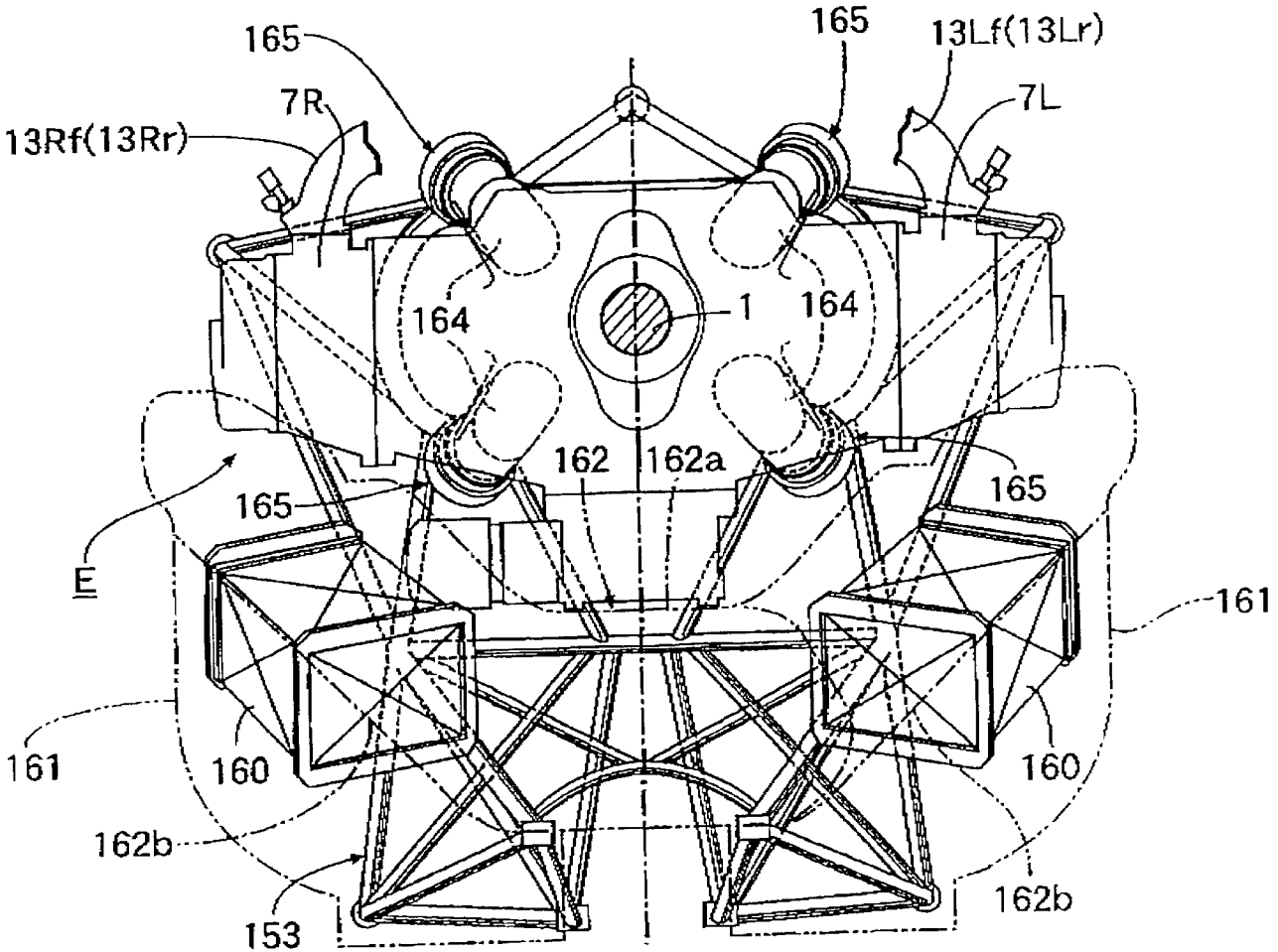
FIG. 6 is a sectional view along line 6—6 of FIG. 5.
Figure 7:
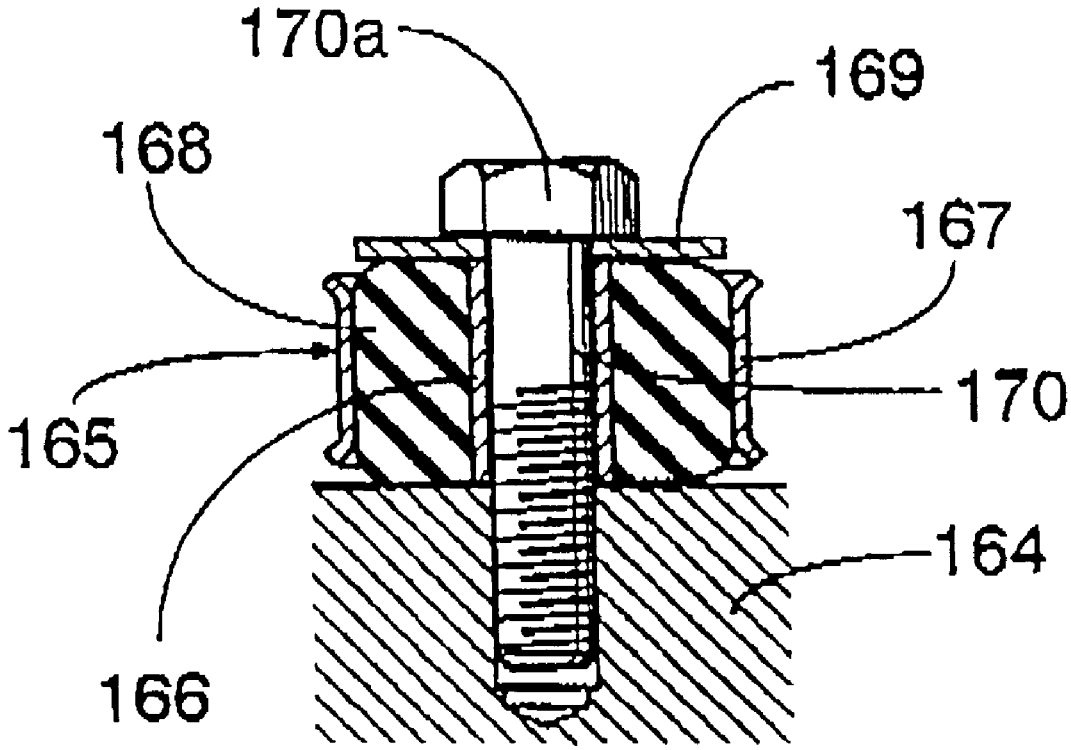
FIG. 7 is an enlarged sectional view along line 7—7 of FIG. 5.

FIG. 1 is a vertical sectional view of a horizontally opposed type internal combustion engine including a crankshaft supporting structure according to the present invention; FIG. 2 is a sectional view taken along line 2—2 of FIG. 1; FIG. 3 is a sectional view taken along line 3—3 of FIG. 1; FIG. 4 is a sectional view taken along line 4—4 of FIG. 1; FIG. 5 is a side elevational view showing an engine installed in an airplane; FIG. 6 is a sectional view along line 6—6 of FIG. 5; and FIG. 7 is an enlarged sectional view along line 7—7 of FIG. 5.

In FIG. 1, symbol E denotes a horizontally opposed type 4-cylinder internal combustion engine for an automobile to which the invention has been applied. The internal combustion engine E includes a crankshaft 1 arranged extending in the front-rear direction of the vehicle. The crankshaft 1 includes four cranks. The No. 1 crank is identified by reference numeral $\mathbf{2}_1$, the No. 2 crank is identified by reference numeral $\mathbf{2}_2$, the No. 3 crank is identified by reference numeral $\mathbf{2}_3$, and the No. 4 crank is identified by reference numeral $\mathbf{2}_4$. The cranks $\mathbf{2}_1$, $\mathbf{2}_2$, $\mathbf{2}_3$ and $\mathbf{2}_4$ are arranged in order from the front to the rear of the vehicle. The crank $\mathbf{2}_1$ and the crank $\mathbf{2}_4$, and the crank $\mathbf{2}_2$ and the crank $\mathbf{2}_3$ are in the same phase with each other. Furthermore, there is a phase difference of 180° between the first and fourth cranks $\mathbf{2}_1$, $\mathbf{2}_4$ and the second and third cranks $\mathbf{2}_2$ and $\mathbf{2}_3$.

In the crankshaft 1, a front journal 3*f* is provided adjacent to the front side of the crank $\mathbf{2}_1$, a middle journal 3*m* is provided at a middle portion between the cranks $\mathbf{2}_2$, $\mathbf{2}_3$, and a rear journal 3*r* is provided adjacent to the rear side of the crank $\mathbf{2}_4$.

The cranks $\mathbf{2}_1$, $\mathbf{2}_3$ are respectively connected with a front-rear pair of first pistons 4L*f*, 4L*r* through connecting rods 5L*f*, 5L*r*. The cranks $\mathbf{2}_2$, $\mathbf{2}_4$ are respectively connected with a front-rear pair of second pistons 4R*f*, 4R*r* through connecting rods 5R*f*, 5R*r*. The first pistons 4L*f*, 4L*r* and the second pistons 4R*f*, 4R*r* are disposed opposite to each other on left and right sides with the axis line A of the crankshaft 1 located therebetween. Thus, the first piston 4L*f* and the second piston 4R*f* are set off from each other along the crank axis line A by the axial distance S between the corresponding No. 1 crank $\mathbf{2}_1$ and No. 2 crank $\mathbf{2}_2$.

As shown in FIG. 4, a crankcase 6 for containing the crankshaft 1 is split along a vertical plane P containing the crank axis line A into a first case half 6L on the side of the first pistons 4L*f*, 4L*r* and a second case half 6R on the side of the second pistons 4R*f*, 4R*r*. As shown in FIGS. 1 to 3, the first and second case halves 6L, 6R are connected with first and second cylinder blocks 7L, 7R by a plurality of bolts 8L, 8L . . . and 8R, 8R . . . at the circumference of each cylinder block. Cylinder sleeves 9L*f*, 9L*r* are integrally joined to the first cylinder block 7L by insert-casting. The cylinder sleeves 9L*f*, 9L*r* have cylinder bores 10L*f*, 10L*r* for slidably receiving the first pistons 4L*f*, 4L*r* therein. On the other hand, cylinder sleeves 9R*f*, 9R*r* are integrally joined to the second cylinder block 7R by insert-casting. The cylinder sleeves 9R*f*, 9R*r* have cylinder bores 10R*f*, 10R*r* for slidably receiving the second pistons 4R*f*, 4R*r* therein. The cylinder sleeves 9L*f*, 9L*r*, 9R*f*, 9R*r* protrude from the inner ends of the first and second cylinder blocks 7L, 7R. The protruding portions are received in sleeve receiving holes 11L, 11R provided in the first and second case halves 6L, 6R. In view of the above, due to the offset between the first and second pistons 4L*f*, 4L*r* and 4R*f*, 4R*r*, the cylinder bores 10L*f*, 10R*f* of the first and second cylinder blocks 7L, 7R are also offset from each other by the distance S along the crank axis line A.

The first case half 6L is provided integrally with three first journal supporting walls 13L*f*, 13L*m*, 13L*r* for supporting half periphery portions of the front journal 3*f*, middle journal 3*m* and rear journal 3*r* through split bushes 12, respectively. Furthermore, the second case half 6R, is provided integrally with three second journal supporting walls 13R*f*, 13R*m*, 13R*r* for supporting the other half periphery portions of the front journal 3*f*, middle journal 3*m* and rear journal 3*r* through split bushes 12, respectively. In this case, the first and second front journal supporting walls 13L*f*, 13R*f* are located at a middle position along the crank axis line A between front walls 7L*f*, 7R*f* of the first and second cylinder blocks 7L, 7R. The first and second middle journal supporting walls 13L*m*, 13R*m* are located at a middle position along the crank axis line A between middle walls 7L*m*, 7R*m* of the first and second cylinder blocks 7L, 7R. The first and second rear journal supporting walls 13L*r*, 13R*r* are located at a middle position along the crank axis line A between rear walls 7L*r*, 7R*r* of the first and second cylinder blocks 7L, 7R. As a result, portions of the first front and middle journal supporting walls 13L*f*, 13L*m* are exposed to the side of the cylinder bores 10L*f*, 10L*r* of the first cylinder block 7L. First rear journal supporting wall 13L*r* is located on the rear side of the rear wall 7L*r* of the first cylinder block 7L. On the other hand, portions of the second middle and rear journal supporting walls 13R*m*, 13R*r* are exposed to the side of the cylinder bores 10R*f*, 10R*r* of the second cylinder block 7R. The second front journal supporting wall 13R*f* is located on the front side of the front wall 7R*f* of the second cylinder block 7R.

The first rear journal supporting wall 13L*r* is provided with a pair of bolt holes 14L, 14L disposed in proximity to and on opposite sides of the rear journal 3*r* of the crankshaft 1. The second rear journal supporting wall 13R*r* is provided with a pair of screw holes 15R, 15R coinciding with the bolt holes 14L, 14L. On the other hand, the second front journal supporting wall 13R*f* is provided with a pair of bolt holes 14R, 14R disposed in proximity to and on opposite sides of the front journal 3*f* of the crankshaft 1. The first front journal supporting wall 13L*f* is provided with a pair of screw holes 15L, 15L coinciding with the bolt holes 14R, 14R.

The first middle journal supporting wall 13L*m* is provided with a pair of bolt holes 16L, 16L opening into the rear cylinder bore 10L*r* of the first cylinder block 7L and disposed in proximity to and on opposite sides of the middle journal 3*m* of the crankshaft 1. The second middle journal supporting wall 13R*m* is provided with a pair of screw holes 17R, 17R coinciding with the bolt holes 16L, 16L. On the other hand, the second middle journal supporting wall 13R*m* is provided with a pair of bolt holes 16R, 16R opening into the front cylinder bore 10R*f* of the second cylinder block 7R and disposed in proximity to and on opposite sides of the middle journal 3*m*. The first middle journal supporting wall 13L*m* is provided with a pair of screw holes 17L, 17L coinciding with the bolt holes 16R, 16R. Thus, the first and second middle journal supporting walls 13L*m*, 13R*m* are provided with pairs of bolt holes 16L, 16L and 16R, 16R and screw holes 17L, 17L and 17R, 17R. In order to prevent the adjacent bolt holes 16L, 16L and 16R, 16R and screw holes 17L, 17L and 17R, 17R from interfering with each other, the bolt holes and screw holes are formed smaller in diameter than the bolt holes 14L, 14L and 14R, 14R and screw holes 15L, 15L and 15R, 15R provided in the first and second front and rear journal supporting walls 13L*f*, 13L*r* and 13R*f*, 13R*r*.

Bolts 18L, 18L; 18R, 18R; 19L, 19L; 19R, 19R passed through the bolt holes 14L, 14L; 14R, 14R; 16L, 16L; 16R, 16R are fitted into the corresponding screw holes 15L, 15L; 15R, 15R; 17L, 17L; 17R, 17R, whereby the opposed first and second journal supporting walls 13L*f*, 13L*m*, 13L*r* and 13R*f*, 13R*m*, 13R*r* are connected to each other.

The first and second case halves 6L, 6R are connected to each other by a plurality of bolts 20, 20 . . . at peripheral portions thereof.

The operation or effects of the embodiment will now be described.

When assembling the internal combustion engine E, first, the connecting rods 5L*f*, 5R*f*, 5L*r*, 5R*r* are only connected to the cranks $\mathbf{2}_1$ to $\mathbf{2}_4$ of the crankshaft 1. The first and second case halves 6L, 6R are connected by sandwiching the crankshaft 1 therebetween. Namely, the bolts 18L, 18L; 18R, 18R; 19L, 19L; 19R, 19R passed through the bolt holes 14L, 14L; 14R, 14R; 16L, 16L; 16R, 16R are fitted into the screw holes 15L, 15L; 15R, 15R; 17L, 17L; 17R, 17R, whereby the opposed first and second journal supporting walls 13L*f*, 13L*m*, 13L*r* and 13R*f*, 13R*m*, 13R*r* are coupled to each other.

In this case, particularly, when coupling the first and second middle journal supporting walls 13L*m*, 13R*m*, fitting of the bolts 19L, 19L and 19R, 19R is carried out easily by utilizing the space inside the rear sleeve receiving hole 11L of the first case half 6L and the space inside the front sleeve receiving hole 11R of the second case half 6R. Therefore, the coupling of the first and second middle supporting walls 13L*m*, 13R*m* can be easily carried out without being interfered with in any way by the first and second cylinder blocks 7L, 7R. In addition, although the amount of exposure of the first and second middle journal supporting walls 13L*m*, 13R*m* to the side of the left and right sleeve receiving holes 11L, 11R is small and therefore small-diameter bolts must be used in coupling the journal supporting walls 13L*m*, 13R*m* together, the first and second middle journal supporting walls 13L*m*, 13R*m* can be provided with a sufficient binding force because the journal supporting walls 13L*m*, 13R*m* are coupled by a total of four bolts 19L, 19L and 19R, 19R which are inserted from the side of the left and right sleeve receiving holes 11L, 11R.

Thus, the first and second middle journal supporting walls 13L*m*, 13R*m* are also bolt-connected in proximity to and on both sides of the crankshaft 1, in the same manner as the first and second front and rear journal supporting walls 13L*f*, 13R*f* and 13L*r*, 13R*r*. Therefore, rigidity of support for the middle journal 3*m* of the crankshaft 1 can be enhanced effectively. As a result, the crankcase 6 can be made small in thickness, leading to a reduction in weight. In addition, since there is no need for a bearing cap for supporting the middle journal 3*m*, it is possible to obtain a reduction in the number of component parts and a simplification in structure.

After the first and second case halves 6L, 6R are coupled, the pistons 4L*f*, 4R*f*, 4L*r*, 4R*r* are connected to the connecting rods 5L*f*, 5R*f*, 5L*r*, 5R*r*. The first cylinder block 7L is connected to the first case half 6L by the bolts 8L, 8L . . . while fitting the first pistons 4L*f*, 4L*r* in the cylinder bores 10L*f*, 10L*r* of the first cylinder block 7L. Similarly, the second cylinder block 7R is connected to the second case half 6R by the bolts 8R, 8R . . . while fitting the second pistons 4R*f*, 4R*r* in the cylinder bores 10R*f*, 10R*r* of the second cylinder block 7R.

It should be noted that when an engine E as described above is installed in an air plane 150 as shown in FIG. 11, the engine E is accommodated in a cowl 152 attached to a front portion of a body 151 such that an axial line of the crankshaft 21 extends in the forward and backward direction. Furthermore, the engine E is resiliently supported on a support frame 153 disposed in the cowl 152.

A spinner 155 having a plurality of propellers 154 is disposed forwardly of the cowl 152, and the crankshaft 21 of the engine E is coupled coaxially to the spinner 155.

Referring also to FIG. 6, an intake manifold 156 is disposed above the engine E and extends in the forward and backward direction. A pair of intake pipes 74L and 74R are connected to the opposite sides of a front portion of the intake manifold 156 such that they communicate with the intake ports 84 of the cylinder heads 15L and 15R of the cylinder blocks 12L and 12R of the engine E.

An air cleaner 157 is disposed below a rear portion of the intake manifold 156 on the rear side of the engine E and is connected to a rear portion of the intake manifold 156. In addition, a suction pipe 158 is connected to a lower portion of the air cleaner 157 and extends forwardly below the engine E. The forward end of the suction pipe 158 is open to a screen 159 provided at a lower portion of the front end of the cowl 152.

A pair of radiators 160, 160 is disposed on the opposite left and right sides of a lower portion of the engine E. The radiators 160, 160 are accommodated in a pair of first air ducts 161, 161, which extends forward and upward. The lower ends of the first air ducts 161, 161 are open obliquely rearward in the cowl 152. A second air duct 162 is connected in common to the upper ends of the two first air ducts 161, 161. The second air duct 162 includes a common duct portion 162*a* extending leftwardly and rightwardly below a front portion of the engine E and having, at a front and central portion thereof, an air intake opening 163 opposed to the screen 159. A pair of branch duct portions 162*b*, 162*b* extend rearward and upward from the opposite left and right end portions of the common duct portion 162*a* and connect to the upper ends of the first air ducts 161, 161.

In particular, the radiators 160, 160 disposed on the opposite left and right sides of a lower portion of the engine E are cooled by air fed from the screen 159 at the front end of the cowl 152 to the air intake opening 163 by the propellers 154 and flowing through the left and right first air ducts 161, 161 separately from the second air duct 162.

The support frame 153 is formed from; for example, a plurality of pipe members combined in such a manner as to embrace the engine E from the rear. In addition; for example, mounting arms 164, 164 are inclined such that the distances between them increase rearwardly at four locations of a rear portion of the crankcase 19 of the engine E. The mounting arms 164, 164 are provided such that they may be positioned at the corners of an imaginary rectangular parallelepiped centered at the axial line of the crankshaft 21 in a plane perpendicular to the axial line. The mounting arms 164, 164, are mounted on the support frame 153 through resilient mounts 165, 165.

Referring to FIG. 7, each resilient mount 165 includes a cylindrical collar 166, a cylindrical support tube 167 fixed to the support frame 153 and coaxially surrounding the collar 166, and a mount rubber member 168 interposed between the collar 166 and the support tube 167 with inner and outer peripheries thereof baked to an outer periphery of the collar 166 and an inner periphery of the support tube 167. Opposite ends of the collar 166 project from the opposite ends of the support tube 167.

The collar 166 has one end contacting with a mounting arm 164. The collar 166 contacts, at the other end thereof, with a holding down plate 169. A bolt 170 has an increased diameter head portion 170a for engaging with an outer face of the holding down plate 169 and extending through the holding down plate 169 and the collar 166. The bolt 170 is screwed in the mounting arm 164 such that the mounting arm 164, i.e., the engine E, is resiliently mounted on the support frame 153 by tightening the bolt 170.

The present invention is not restricted to or by the above-mentioned embodiments, and various modifications in design can be made without stepping out of the gist of the invention. For instance, the first cylinder block 7L can be formed integrally with the first case half 6L, and the second cylinder block 7R can be formed integrally with the second case half 6R. In that case, when transverse holes capable of inserting piston pins therein are provided in portions of the cylinder blocks 7L, 7R proximate to the case halves 6L, 6R, connection of the pistons 4L*f*, 4L*r* and 4R*f*, 4R*r* with the connecting rods 5L*f*, 5L*r* and 5R*f*, 5R*r* is carried out in spite of the presence of the cylinder blocks 7L, 7R. In addition, the horizontally opposed type internal combustion engine according to the present invention can be applied also to internal combustion engines having six or more cylinders. Furthermore, by disposing a crankshaft along a center line of a vehicle, the horizontally opposed type internal combustion engine according to the invention can be used not only for automobiles but also for motorcycles and airplanes.

As has been described above, according to the first characteristic feature of the present invention, a horizontally opposed type internal combustion engine includes a crankshaft and pluralities of first and second pistons connected to the crankshaft, disposed opposite to each other with the crankshaft therebetween and arranged with an offset from each other along the axial direction of the crankshaft. A crankcase is included for containing and supporting the crankshaft, and first and second cylinder blocks are connected to and disposed on opposite sides of the crankcase and have cylinder bores for slidably receiving therein the first and second pistons. The crankcase is split along a plane containing the axis of the crankshaft into first and second case halves connected respectively with the first and second cylinder blocks. The first and second case halves are integrally provided with first and second journal supporting walls rotatably supporting a middle journal of the crankshaft therebetween. The first and second journal supporting walls front the cylinder bores of the first and second cylinder blocks, and the first and second journal supporting walls are connected by a plurality of first bolts inserted from the side of the cylinder bore of the first cylinder block and disposed on opposite sides of and in proximity to the middle journal. With this construction, the first and second journal supporting walls for supporting the middle journal of the crankshaft therebetween can be bolt-connected easily without being interfered with by the presence of the first and second cylinder blocks. Both of the journal supporting walls are bolt-connected on both sides of and in proximity to the middle journal of the crankshaft, whereby rigidity of support for the middle journal of the crankshaft can be enhanced effectively. Therefore, the crankcase can be made small in thickness, leading to a reduction in weight. In addition, there is no need for a bearing cap for supporting the crankshaft, which enables a reduction in the number of component parts and a simplification in structure.

According to the second characteristic feature, in addition to the first characteristic feature, the first and second journal supporting walls are connected by a plurality of second bolts inserted from the side of the cylinder bore of the second cylinder block and arranged on opposite sides of and in proximity to the middle journal. Therefore, even though the amount of exposure of the first and second supporting walls into the cylinder bores of the first and second cylinder blocks is small and the bolts used are small in diameter, the journal supporting walls can be connected using at least four bolts inserted from the sides of the first and second cylinder blocks. Accordingly, the journal supporting walls can be provided with a sufficient binding force.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankshaft supporting structure for a horizontally opposed type internal combustion engine, the engine including a crankshaft having a plurality of journals, first and second pluralities of pistons connected to the crankshaft and disposed opposite to each other with the crankshaft therebetween and arranged with an offset from each other along an axial direction of the crankshaft, a crankcase for containing and supporting the crankshaft, and first and second cylinder blocks connected to and disposed on opposite sides of the crankcase and having cylinder bores for slidably receiving therein the first and second pluralities of pistons, respectively, the crankcase being split along a plane containing an axis of the crankshaft into first and second case halves connected respectively with the first and second cylinder blocks, said crankshaft supporting structure comprising:

said first and second case halves being integrally provided with first and second journal supporting walls, respectively, for rotatably supporting a middle journal of said plurality of journals of the crankshaft therebetween, said first and second journal supporting walls for facing the cylinder bores of the first and second cylinder blocks; and said first and second journal supporting walls being connected by a plurality of first bolts inserted from a side of the cylinder bores of the first cylinder block and disposed on opposite sides of and in proximity to the middle journal, the plurality of first bolts opening into the cylinder bores.

2. The crankshaft supporting structure for a horizontally opposed type internal combustion engine according to claim 1, wherein said first and second journal supporting walls are connected by a plurality of second bolts inserted from a side of the cylinder bores of the second cylinder block and disposed on opposite sides of and in proximity to the middle journal.

3. The crankshaft supporting structure for a horizontally opposed type internal combustion engine according to claim 1, wherein said first and second case halves are integrally provided with first front and rear journal supporting walls and second front and rear journal supporting walls, respectively, said first and second front journal supporting walls being connected by a plurality of bolts inserted from a side of the cylinder bores of one of the first and second cylinder blocks and disposed on opposite sides of and in proximity to a front journal of said plurality of journals, said first and second rear journal supporting walls being connected by a plurality of bolts inserted from a side of the cylinder bores of the other of the first and second cylinder blocks and disposed on opposite sides of and in proximity to a rear journal of said plurality of journals.

4. The crankshaft supporting structure for a horizontally opposed type internal combustion engine according to claim 2, wherein said first and second case halves are integrally provided with first front and rear journal supporting walls and second front and rear journal supporting walls, respectively, said first and second front journal supporting walls being connected by a plurality of bolts inserted from a side of the cylinder bores of one of the first and second cylinder blocks and disposed on opposite sides of and in proximity to a front journal of said plurality of journals, said first and second rear journal supporting walls being connected by a plurality of bolts inserted from a side of the cylinder bores of the other of the first and second cylinder blocks and disposed on opposite sides of and in proximity to a rear journal of said plurality of journals.

5. The crankshaft supporting structure for a horizontally opposed type internal combustion engine according to claim 1, wherein an axis of each of said plurality of first bolts passes through one of the cylinder bores of each of the first and second cylinder blocks.

6. The crankshaft supporting structure for a horizontally opposed type internal combustion engine according to claim 2, wherein an axis of each of said plurality of first bolts and each of said plurality of second bolts passes through one of the cylinder bores of each of said first and second cylinder blocks.

7. A crankshaft supporting structure for a horizontally opposed type internal combustion engine, comprising:

a crankcase for containing and supporting the crankshaft, said crankcase being connectable to first and second cylinder blocks of the engine disposed on opposite sides of said crankcase and having cylinder bores for slidably receiving therein first and second pluralities of pistons of the engines respectively, said crankcase being split along a plane containing an axis of the crankshaft into first and second case halves connectable respectively with the first and second cylinder blocks;

said first and second case halves being integrally provided with first and second journal supporting walls, respectively, for rotatably supporting a middle journal of said crankshaft therebetween, said first and second journal supporting walls for facing the cylinder bores of the first and second cylinder blocks; and said first and second journal supporting walls being connected by a plurality of first bolts inserted from a side of the cylinder bores of the first cylinder block and disposed on opposite sides of and in proximity to the middle journal, the plurality of first bolts opening into the cylinder bores.

8. The crankshaft supporting structure for a horizontally opposed type internal combustion engine according to claim 7, wherein said first and second journal supporting walls are connected by a plurality of second bolts inserted from a side of the cylinder bores of the second cylinder block and disposed on opposite sides of and in proximity to the middle journal.

9. The crankshaft supporting structure for a horizontally opposed type internal combustion engine according to claim 7, wherein said first and second case halves are integrally provided with first front and rear journal supporting walls and second front and rear journal supporting walls, respectively, said first and second front journal supporting walls being connected by a plurality of bolts inserted from a side of the cylinder bores of one of the first and second cylinder blocks and disposed on opposite sides of and in proximity to a front journal of the plurality of journals, said first and second rear journal supporting walls being connected by a plurality of bolts inserted from a side of the cylinder bores of the other of the first and second cylinder blocks and disposed on opposite sides of and in proximity to a rear journal of the plurality of journals.

10. The crankshaft supporting structure for a horizontally opposed type internal combustion engine according to claim 8, wherein said first and second case halves are integrally provided with first front and rear journal supporting walls and second front and rear journal supporting walls, respectively, said first and second front journal supporting walls being connected by a plurality of bolts inserted from a side of the cylinder bores of one of the first and second cylinder blocks and disposed on opposite sides of and in proximity to a front journal of the plurality of journals, said first and second rear journal supporting walls being connected by a plurality of bolts inserted from a side of the cylinder bores of the other of the first and second cylinder blocks and disposed on opposite sides of and in proximity to a rear journal of the plurality of journals.

11. The crankshaft supporting structure for a horizontally opposed type internal combustion engine according to claim 7, wherein an axis of each of said plurality of first bolts passes through one of the cylinder bores of each of the first and second cylinder blocks.

12. The crankshaft supporting structure for a horizontally opposed type internal combustion engine according to claim 8, wherein an axis of each of said plurality of first bolts and each of said plurality of second bolts passes through one of the cylinder bores of each of the first and second cylinder blocks.

13. A horizontally opposed type internal combustion engine, comprising:

a crankshaft having a plurality of journals;

first and second pluralities of pistons connected to said crankshaft, said first and second pluralities of pistons being disposed opposite to each other with said crankshaft therebetween and arranged with an offset from each other along an axial direction of said crankshaft;

a crankcase for containing and supporting said crankshaft;

first and second cylinder blocks, said first and second cylinder blocks being connected to and disposed on opposite sides of said crankcase and having cylinder bores for slidably receiving therein said first and second pluralities of pistons, respectively, said crankcase being split along a plane containing an axis of the crankshaft into first and second case halves connected respectively with the first and second cylinder blocks; and a crankshaft supporting structure, said crankshaft supporting structure comprising:

said first and second case halves being integrally provided with first and second journal supporting walls, respectively, for rotatably supporting a middle journal of said plurality of journals of said crankshaft therebetween, said first and second journal supporting walls facing said cylinder bores of said first and second cylinder blocks; and said first and second journal supporting walls being connected by a plurality of first bolts inserted from a side of said cylinder bores of said first cylinder block and disposed on opposite sides of and in proximity to said middle journal, the plurality of first bolts opening into the cylinder bores.

14. The horizontally opposed type internal combustion engine according to claim 13, wherein said first and second journal supporting walls are connected by a plurality of second bolts inserted from a side of said cylinder bores of said second cylinder block and disposed on opposite sides of and in proximity to said middle journal.

15. The horizontally opposed type internal combustion engine according to claim 13, wherein said first and second case halves are integrally provided with first front and rear journal supporting walls and second front and rear journal supporting walls, respectively, said first and second front journal supporting walls being connected by a plurality of bolts inserted from a side of said cylinder bores of one of said first and second cylinder blocks and disposed on opposite sides of and in proximity to a front journal of said plurality of journals, said first and second rear journal supporting walls being connected by a plurality of bolts inserted from a side of said cylinder bores of the other of said first and second cylinder blocks and disposed on opposite sides of and in proximity to a rear journal of said plurality of journals.

16. The horizontally opposed type internal combustion engine according to claim 14, wherein said first and second case halves are integrally provided with first front and rear journal supporting walls and second front and rear journal supporting walls, respectively, said first and second front journal supporting walls being connected by a plurality of bolts inserted from a side of said cylinder bores of one of said first and second cylinder blocks and disposed on opposite sides of and in proximity to a front journal of said plurality of journals, said first and second rear journal supporting walls being connected by a plurality of bolts inserted from a side of said cylinder bores of the other of said first and second cylinder blocks and disposed on opposite sides of and in proximity to a rear journal of said plurality of journals.

17. The horizontally opposed type internal combustion engine according to claim 13, wherein an axis of each of said plurality of first bolts passes through one of said cylinder bores of each of said first and second cylinder blocks.

18. The horizontally opposed type internal combustion engine according to claim 14, wherein an axis of each of said plurality of first bolts and each of said plurality of second bolts passes through one of said cylinder bores of each of said first and second cylinder blocks.

* * * * *